US009114815B2

(12) United States Patent
Brodie

(10) Patent No.: US 9,114,815 B2
(45) Date of Patent: Aug. 25, 2015

(54) ASSEMBLY FOR EXTENDABLE RAIL-SUPPORTED VEHICLE COUPLER

(71) Applicant: Brandt Road Rail Corporation, Regina (CA)

(72) Inventor: David Brodie, Regina (CA)

(73) Assignee: Brandt Road Rail Corporation, Regina, SK (CA)

( * ) Notice: Subject to any disclaimer, the term of this patent is extended or adjusted under 35 U.S.C. 154(b) by 150 days.

(21) Appl. No.: 13/804,482

(22) Filed: Mar. 14, 2013

(65) Prior Publication Data

US 2014/0263146 A1 Sep. 18, 2014

(51) Int. Cl.
*B61G 7/10* (2006.01)
*B61G 7/08* (2006.01)

(52) U.S. Cl.
CPC ... *B61G 7/10* (2013.01); *B61G 7/08* (2013.01)

(58) Field of Classification Search
CPC ..... B61G 7/08; B61G 7/10; B61G 5/06; B61G 7/12; B60D 1/54
USPC ..... 213/4, 18, 74, 6, 63, 12, 76
See application file for complete search history.

(56) References Cited

U.S. PATENT DOCUMENTS 2,027,269 A 1/1936 Einwaechter
2,056,834 A 10/1936 De Haven
2,164,703 A 7/1939 Elsey
2,212,646 A 8/1940 Nekola
2,246,406 A 6/1941 Wittmer
2,250,993 A 7/1941 Kinne
2,251,982 A 8/1941 Card
2,271,839 A 2/1942 Kayler
2,287,954 A 6/1942 Wolfe
2,323,060 A 6/1943 Larsson
2,378,455 A 6/1945 Wolfe
2,408,653 A 10/1946 Kinne
2,421,153 A 5/1947 Kinne
2,632,572 A * 3/1953 Gilchrist ..... 213/4
3,572,518 A 3/1971 Wisler
3,637,089 A 1/1972 Jwuc
3,693,809 A 9/1972 Metzger
3,779,397 A 12/1973 De Penti
3,856,156 A 12/1974 Metzger
3,857,495 A 12/1974 Kaufhold
3,871,530 A 3/1975 Ray
3,872,978 A 3/1975 Altherr
3,884,448 A 5/1975 Millar
3,971,479 A 7/1976 DePenti
4,024,958 A 5/1977 Kaufhold
4,049,128 A 9/1977 Jeffrey
4,059,192 A 11/1977 Larsen
4,084,704 A 4/1978 Metzger
4,090,615 A 5/1978 Martin (Continued)

FOREIGN PATENT DOCUMENTS

CA 1037911 9/1978
CA 1041952 11/1978

(Continued)

*Primary Examiner* — Mark Le
(74) *Attorney, Agent, or Firm* — Frost Brown Todd LLC

(57) ABSTRACT

A railcar coupler assembly allowing rotation of a coupler between a stored position within the railcar and an extended position for engagement with the coupler of an adjacent railcar. The coupler can be locked into either the stored or extended position with a locking pin.

2 Claims, 13 Drawing Sheets

(56) References Cited

U.S. PATENT DOCUMENTS

| | | | | |
|---|---|---|---|---|
| 4,109,930 | A * | 8/1978 | Pilhall | 280/491.4 |
| 4,129,219 | A | 12/1978 | Polanin | |
| 4,135,629 | A | 1/1979 | Dilg | |
| 4,146,143 | A | 3/1979 | Schelle | |
| 4,426,012 | A | 1/1984 | Adams et al. | |
| 4,438,854 | A | 3/1984 | Baughman et al. | |
| 4,544,072 | A | 10/1985 | Randolph | |
| 4,605,133 | A | 8/1986 | Altherr | |
| 4,813,555 | A | 3/1989 | Cripe et al. | |
| 5,582,307 | A | 12/1996 | Hawthorne et al. | |
| 6,129,227 | A | 10/2000 | Openchowski et al. | |
| 6,206,215 | B1 | 3/2001 | Maa | |
| 6,290,079 | B1 | 9/2001 | Altherr | |
| 7,070,062 | B2 | 7/2006 | Trescott | |
| 7,537,246 | B2 | 5/2009 | Mikiya et al. | |
| 7,568,502 | B2 | 8/2009 | Marquis | |
| 7,837,046 | B2 | 11/2010 | Brewster | |
| 8,056,741 | B2 | 11/2011 | Mautino | |
| 8,141,726 | B2 | 3/2012 | Forbes et al. | |
| 8,297,455 | B2 | 10/2012 | Smyth | |
| 8,302,790 | B2 | 11/2012 | Dumey | |
| 8,342,481 | B2 | 1/2013 | Tausch et al. | |
| 2008/0169628 | A1 * | 7/2008 | Kerpash | 280/491.3 |
| 2011/0012344 | A1 | 1/2011 | Tausch et al. | |
| 2011/0012346 | A1 | 1/2011 | Tausch et al. | |
| 2011/0168655 | A1 | 7/2011 | Nibouar et al. | |

FOREIGN PATENT DOCUMENTS

| | | |
|---|---|---|
| CA | 1049454 | 2/1979 |
| CA | 1087846 | 10/1980 |
| CA | 1087847 | 10/1980 |
| CA | 1088272 | 10/1980 |
| CA | 1098087 | 3/1981 |
| CA | 1158606 | 12/1983 |
| CA | 1178931 | 12/1984 |
| CA | 1190575 | 7/1985 |
| CA | 1195660 | 10/1985 |
| CA | 1210364 | 8/1986 |
| CA | 1216826 | 1/1987 |
| CA | 1226244 | 9/1987 |
| CA | 1269124 | 5/1990 |
| CA | 1269126 | 5/1990 |
| CA | 1286339 | 7/1991 |
| CA | 2205761 | 11/1997 |
| CA | 2274981 | 12/1999 |
| CA | 2395875 | 7/2003 |
| CA | 2446484 | 4/2004 |
| CA | 2573306 | 2/2006 |
| CA | 2707736 | 2/2006 |
| CA | 2620670 | 6/2007 |
| CA | 2714047 | 2/2012 |
| CA | 2758318 | 2/2012 |
| WO | WO 96/10452 | 4/1996 |
| WO | WO 00/56052 | 9/2000 |
| WO | WO 2007/124140 | 11/2007 |
| WO | WO 2008/029112 | 3/2008 |
| WO | WO 2009/094926 | 8/2009 |
| WO | WO 2009/110808 | 11/2009 |
| WO | WO 2010/014389 | 2/2010 |
| WO | WO 2010/032101 | 3/2010 |
| WO | WO 2010/061165 | 6/2010 |
| WO | WO 2011/034688 | 3/2011 |
| WO | WO 2011/056683 | 5/2011 |
| WO | WO 2011/084992 | 7/2011 |
| WO | WO 2011/094119 | 8/2011 |
| WO | WO 2012/021150 | 2/2012 |
| WO | WO 2012/021642 | 2/2012 |
| WO | WO 2012/129340 | 9/2012 |

* cited by examiner

ASSEMBLY FOR EXTENDABLE RAIL-SUPPORTED VEHICLE COUPLER

FIELD

The present disclosure relates to coupling assemblies for rail-supported vehicles such as railcars and road/rail vehicles.

BACKGROUND

It is known in the art of rail-supported vehicles or rolling stock to connect multiple units into a single train to enable transportation of increased amounts of materials or passengers. This connection is achieved by means of a coupling mechanism between cars, and numerous coupling mechanisms have been developed and standardized over the years. One example of such a coupling mechanism is the Janney coupler or knuckle coupler, which was subject of U.S. Pat. No. 138,405 and is in wide usage under specifications overseen by the Association of American Railroads, or AAR. An example of a prior art coupler is shown in FIG. 1*a*, the coupler 1 comprising a head 2 and pivot end 4 connected by a shank 3. Railcars are provided with both a coupler and a brake pipe, and both are connected to the coupler and brake pipe of an adjacent railcar to achieve the desired utility. The couplers are commonly situated within a rigid housing that allows for limited side-to-side motion, on the order of 10 degrees rotation off of the direction of travel, to enable both connection to the adjacent railcar and necessary connection flexibility during transport. An example of a prior art coupler within a housing is shown in FIG. 1*b*, the coupler 8 situated within a housing 5 and retained between housing walls 6 and 7 to limit side-to-side rotation of the coupler 8 while allowing projection of the coupler head 9.

While it is common to see such couplers projecting forwardly and/or rearwardly of railway cars, it has been found that there are situations where such projection is undesirable. For example, in the case of so-called road/rail vehicles which can be driven on either rails or flat road surfaces due to the presence of both rail wheels and rubber tires, the projection of an unused coupler may result in a total vehicle length that exceeds highway use regulations. Also, certain maintenance of way equipment might benefit from a selectively projectable coupler.

What is needed, therefore, is a means for selectively projecting a coupler in a rail-supported vehicle.

BRIEF SUMMARY

The present assemblies and methods therefore seek to provide a coupler assembly that allows for the selective projection and retraction of the coupler and preferably the brake pipe.

According to a broad aspect of the present disclosure, then, there is provided a coupler assembly for use with a rail-supportable vehicle comprising:

a frame for mounting substantially within an exterior surface of the vehicle adjacent a first aperture in the exterior surface; and a coupler received within the frame, the coupler having opposed first and second ends, the first end configured for releasable engagement with an adjacent vehicle coupler and the second end pivotally mounted on the frame;

wherein the coupler is rotatable between a stored position substantially within the exterior surface and an extended position partially without the exterior surface through the first aperture for releasable engagement with the adjacent vehicle coupler.

In exemplary embodiments, the coupler may be fully contained within the exterior surface when in the stored position. The exterior surface may comprise a front and/or rear bumper, in which case the frame is housed within the bumper, and the coupler is therefore within the bumper when in the stored position and partially without the bumper when in the extended position, and the coupler is preferably fully contained within the bumper when in the stored position.

The assembly may further comprise a pivot pin in the frame for enabling the coupler rotation, wherein the second end of the coupler comprises a hole for receiving the pivot pin, such that the coupler is pivotable around the pivot pin between the stored and extended positions.

The assembly may further comprise locking means on the frame for releasably securing the coupler in the stored position or the extended position. The locking means preferably comprise a removable locking pin receivable within the frame in a rotational path of travel of the coupler between the stored and extended positions, such that the locking pin substantially prevents the coupler from moving between the stored and extended positions when the locking pin is received within the frame. As it is commonly desirable to allow certain couplers some side-to-side freedom of movement, the locking pin is preferably configured to allow limited rotational movement of the coupler when the coupler is in the extended position.

The assembly preferably further comprises a rotatable brake pipe mounting bracket for a brake pipe of the vehicle adjacent a second aperture in the exterior surface, although the first and second apertures may be a single aperture in the exterior surface or bumper. The rotatable brake pipe mounting bracket may be configured to allow rotation of the brake pipe from a first position within the exterior surface or bumper to a second position partially without the exterior surface or bumper through the second aperture for engagement with an adjacent vehicle brake pipe. In this way, the brake pipe can be retracted where desirable, for example when required by highway use regulations, and it can be configured for mounting on the inside of the exterior surface adjacent the second aperture. The rotatable brake pipe mounting bracket preferably comprises first and second securing means, the first securing means configured to releasably secure the brake pipe in the first position and the second securing means configured to releasably secure the brake pipe in the second position.

A detailed description of an exemplary embodiment is given in the following. It is to be understood, however, that the invention is not to be construed as being limited to this embodiment.

BRIEF DESCRIPTION OF THE DRAWING

In the accompanying drawings, which illustrate an exemplary embodiment.

An exemplary embodiment of the present disclosure will now be described with reference to the accompanying drawings.

DETAILED DESCRIPTION

In the following description, specific materials and dimensions are not addressed as such may vary by situation and will be determined at least in part by regulations, all of which would be known to those skilled in the art. In addition, the means for attaching the assembly to a particular rail-supportable vehicle will depend in part on the vehicle support structure and will accordingly not be canvassed herein.

Figure 1B:
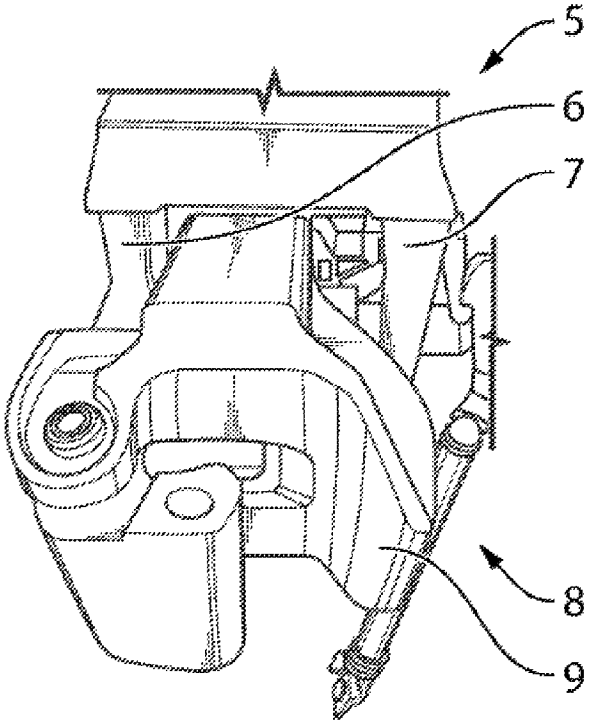
FIG. 1b PRIOR ART
FIGS. 1*a* and 1*b* show a prior art coupler alone and in a housing.
Figure 1A:
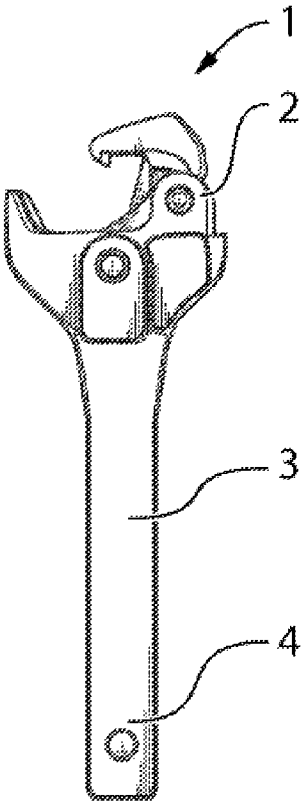
FIG. 1a PRIOR ART

Turning to FIGS. 2*a* through 2*f*, an exemplary coupler assembly is illustrated and identified by reference numeral 10. The assembly 10 comprises a frame 12 which is configured for attachment to the internal structure of a rail-supported vehicle (not shown) in a manner which will be situation-specific but within the knowledge of those skilled in the art. The assembly 10 also includes a coupler 14, which coupler 14 comprises a shank 32 with a first end 16 provided with a standard coupling interface (which in the illustrated example is an AAR coupler) and a second end 18 pivotally mounted on the frame 12. The second end 18 is mounted on the frame 12 by means of a vertical pivot pin 20 which is housed in an appropriately configured set of holes 22 in the second end 18 and the frame 12. As can be seen with reference to the prior art embodiment of FIG. 1*a*, the shank 32 of the illustrated embodiment can be much shorter in appropriate circumstances.

The coupler 14 is accordingly capable of rotation in a generally horizontal plane. At rest or during rotational motion, the coupler 14 sits on top of a supporting platform 34 which is integrated into the frame 12. The supporting platform 34 helps to provide structural strength and ensure properly aligned movement of the coupler 14.

Figure 2A:
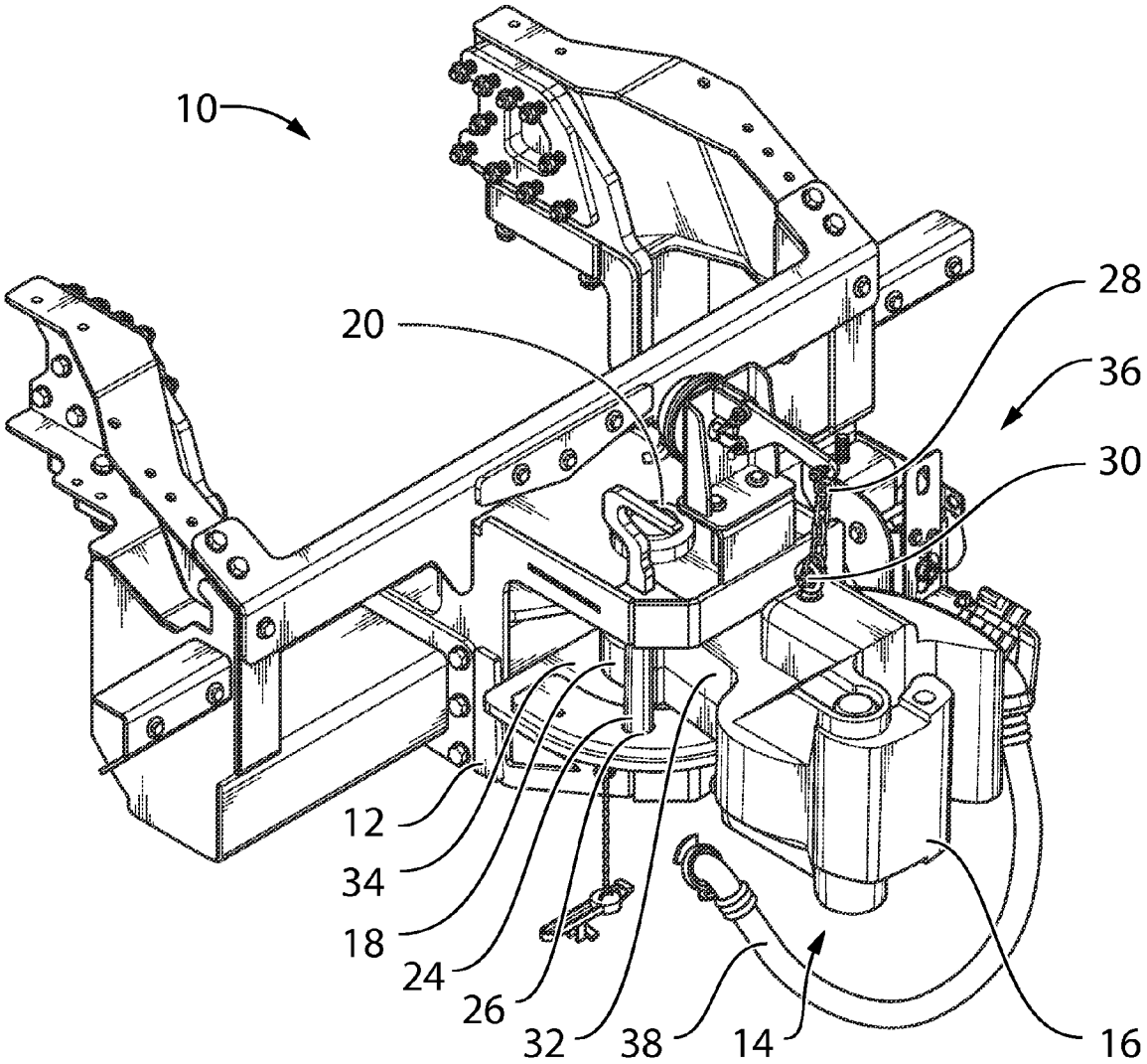
FIG. 2*a* is top perspective view of a coupler assembly according to the present disclosure with the coupler in the extended position.
Figure 2B:
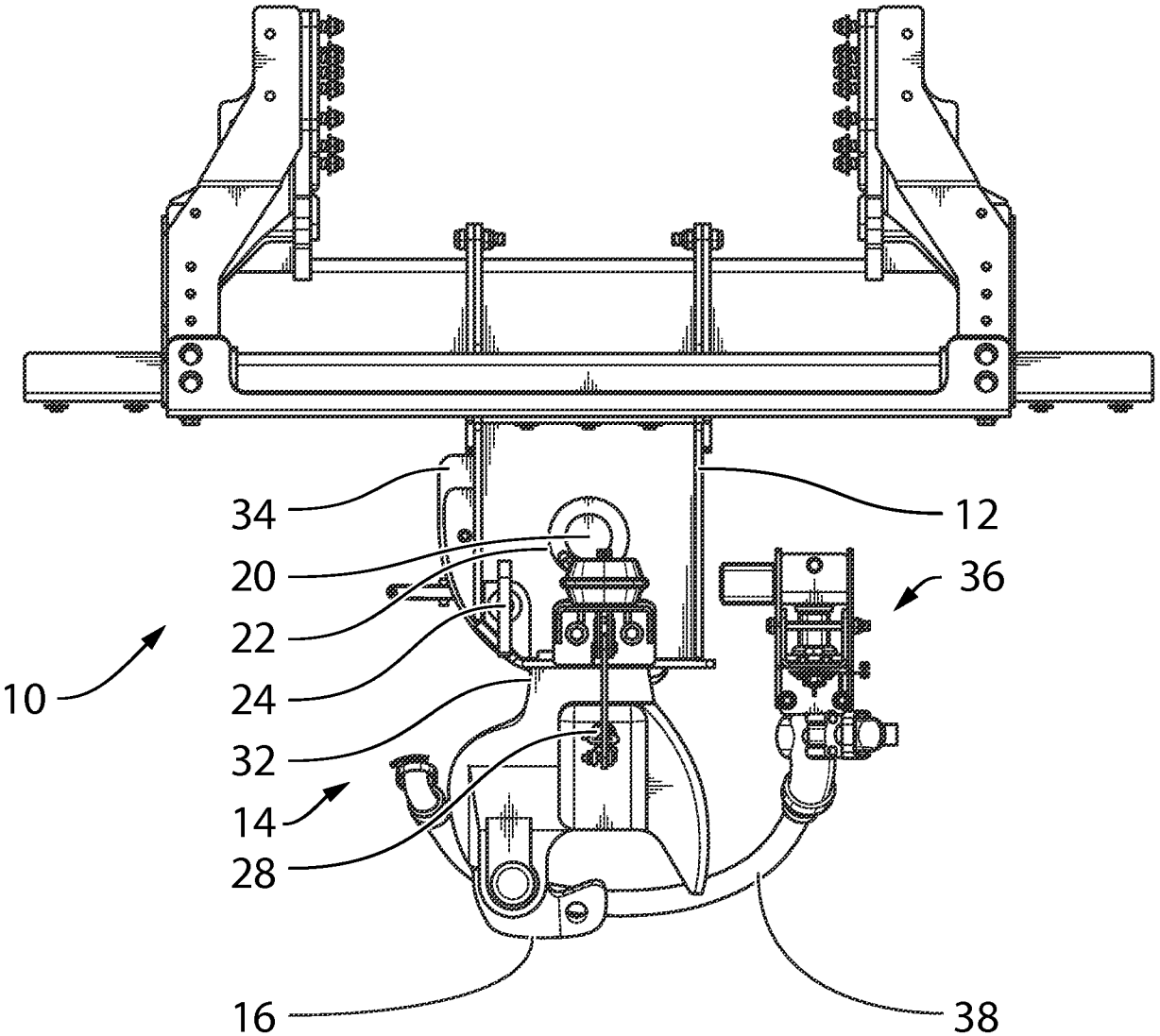
FIG. 2*b* is a top plan view of the coupler assembly of FIG. 2*a* in the extended position.
Figure 2C:
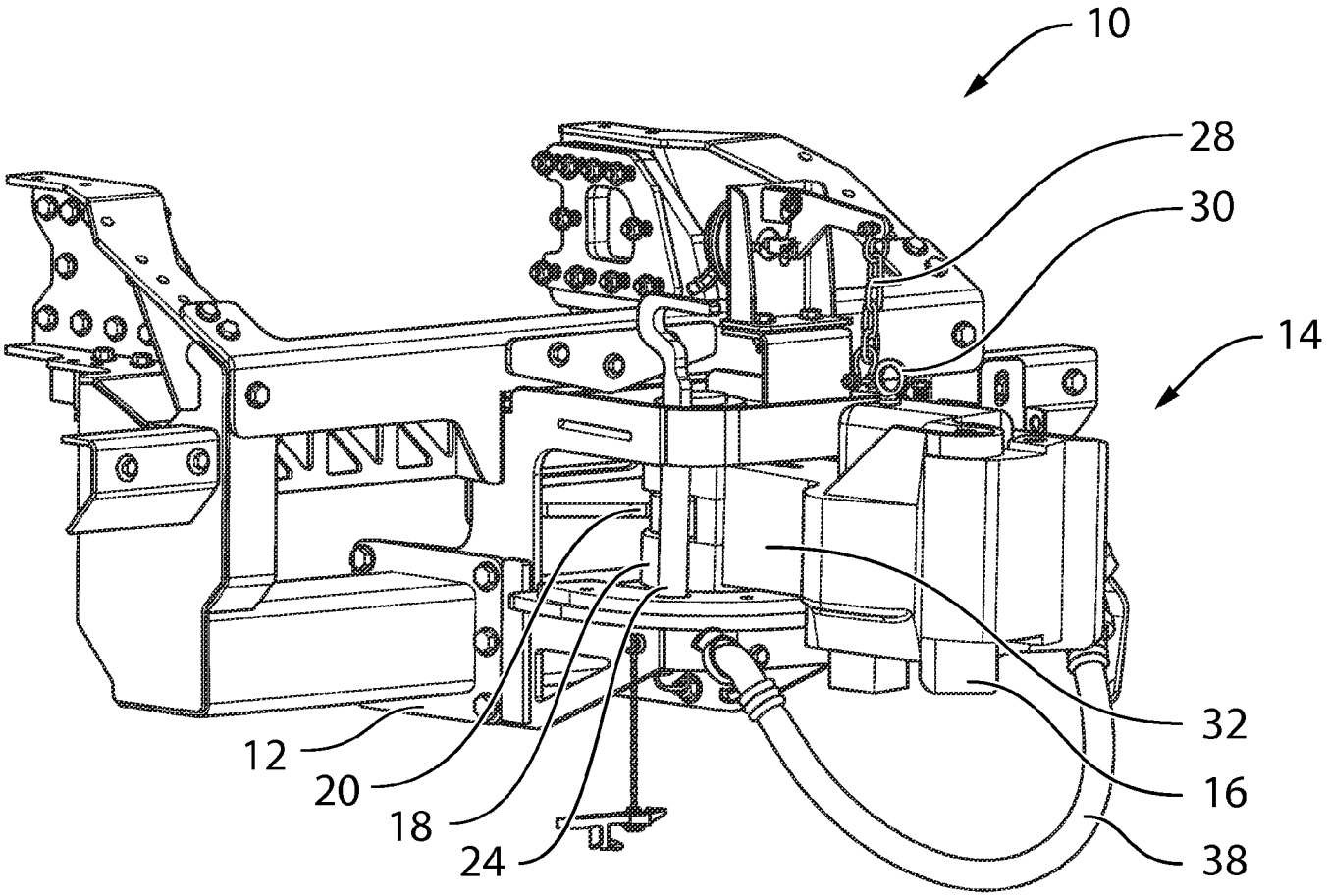
FIG. 2*c* is a side perspective view of the coupler assembly of FIG. 2*a* in the extended position.
Figure 2D:
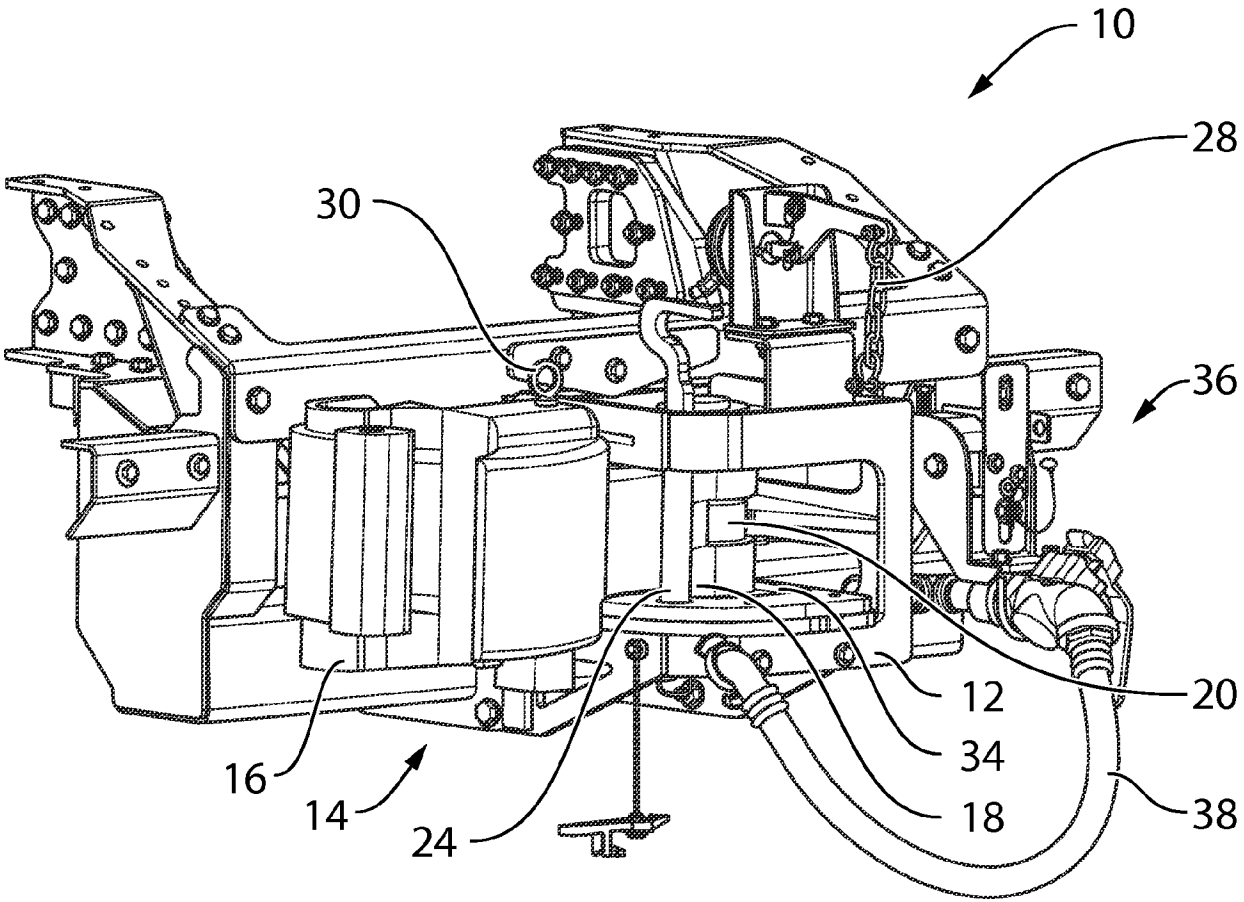
FIG. 2*d* is a side perspective view of the coupler assembly of FIG. 2*a* in the stored position.

As indicated above, the coupler 14 is intended to be rotatable from an extended position (as illustrated in FIGS. 2*a* through 2*c*) to a stored position (as illustrated in FIG. 2*d*) and vice versa. The second end 18 of the coupler 14 is held in place by the pivot pin 20, such that the first end 16 of the coupler 14 can rotate between the two positions across the supporting platform 34. Rotation of the first end 16 of the coupler 14 is restricted by locking means, which in the illustrated embodiment is a locking pin 24 removably positioned in a set of holes 26 in the frame 12. When the coupler 14 is in the extended position, the locking pin 24 blocks the coupler 14 from rotating to the stored position, although the location of the holes 26 for the locking pin 24 is preferably determined such that the coupler 14 has some lateral play as would be known to those skilled in the art as desirable in certain situations. The illustrated embodiment also includes a securing chain 28 on the frame 12 and a corresponding loop 30 on the coupler 14, which can be connected for added security of the engagement. When locked in this manner, the first end 16 of the coupler 14 can be allowed to engage a corresponding coupler of an adjacent rail-supported vehicle. When it is desired to disable such functionality, the first end 16 of the coupler 14 can be moved to the stored position by removing the locking pin 24 from the holes 26 and then manually rotating the coupler 14 to the stored position. Once the coupler 14 has been rotated to the stored position, the locking pin 24 can then be reinserted into the holes 26, thereby blocking the coupler 14 from rotating toward the extended position. Although other types of locking means are possible and intended to be included within the scope of the present invention, including separate locking mechanisms for each of the stored and extended coupler positions, there are obvious advantages to having a single locking pin accomplishing all necessary locking functions. Also, partially or fully automated locking mechanisms would be possible within the scope of the present invention.

Figure 2E:
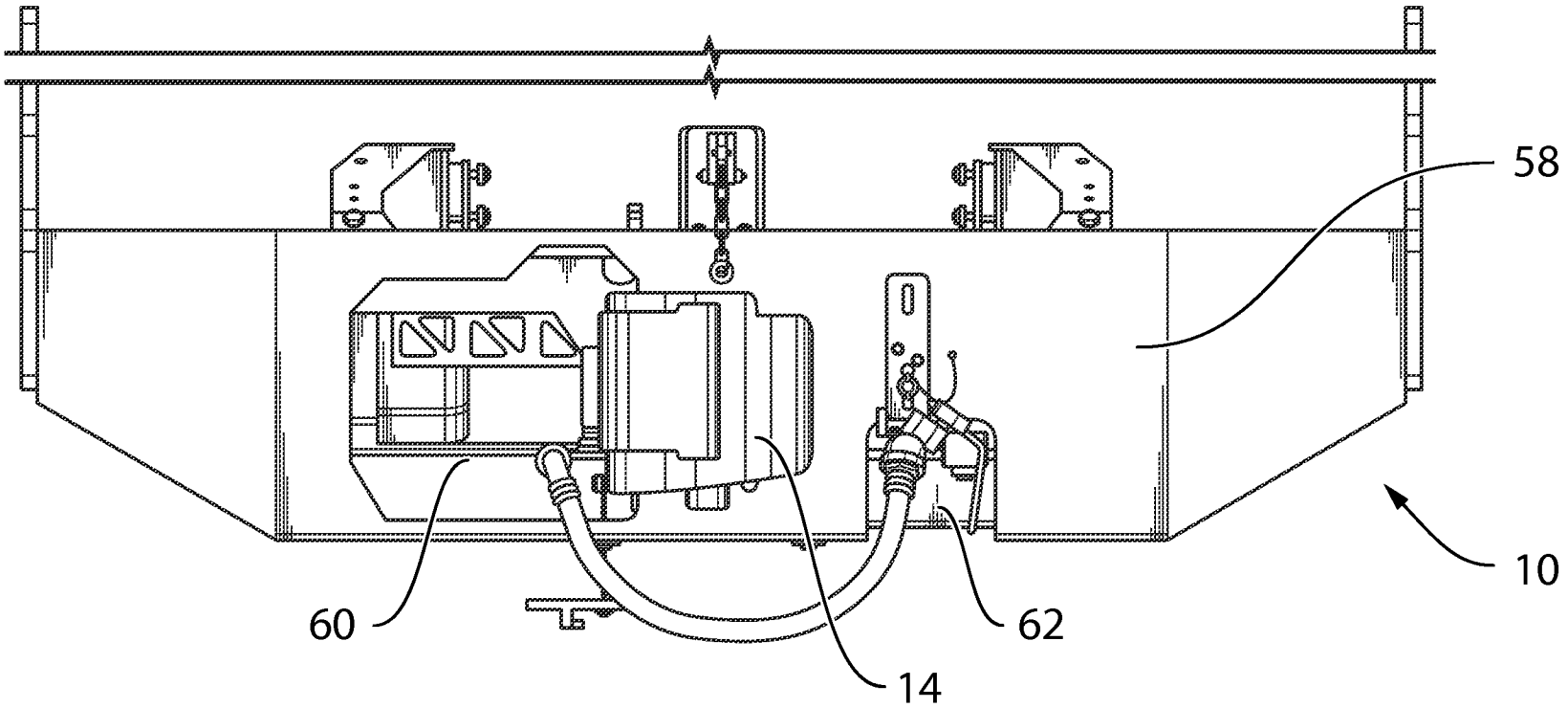
FIG. 2*e* is a front elevation view of a road/rail vehicle bumper with an assembly according to the present disclosure installed therein.
Figure 2F:
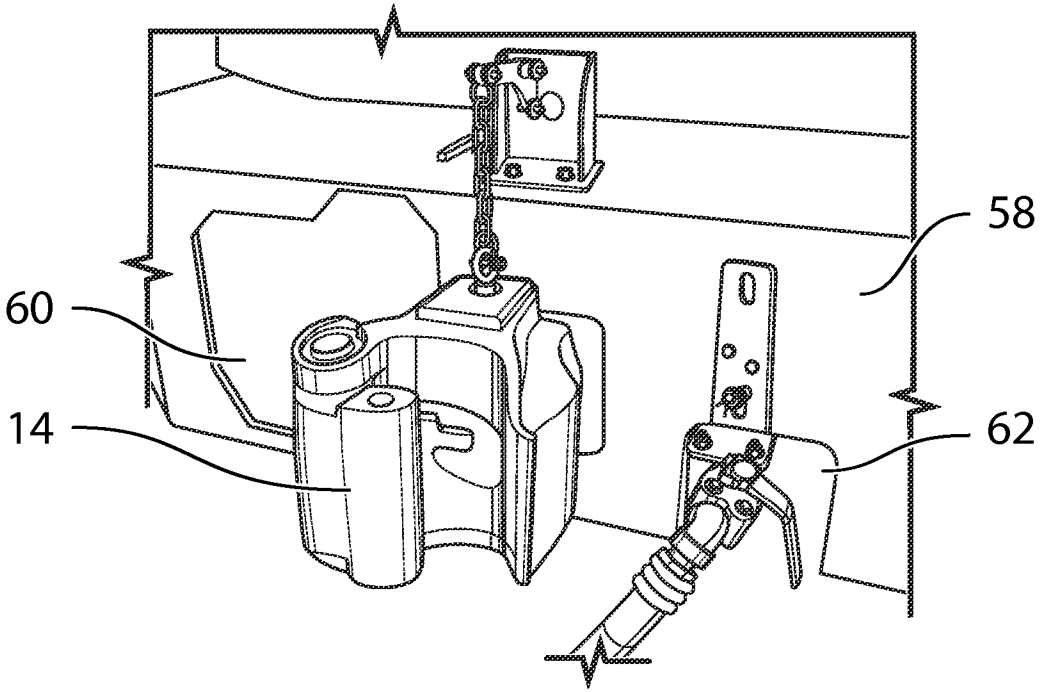
FIG. 2*f* is a front perspective view of a road/rail vehicle bumper with an assembly according to the present disclosure installed therein.
Figure 3A:
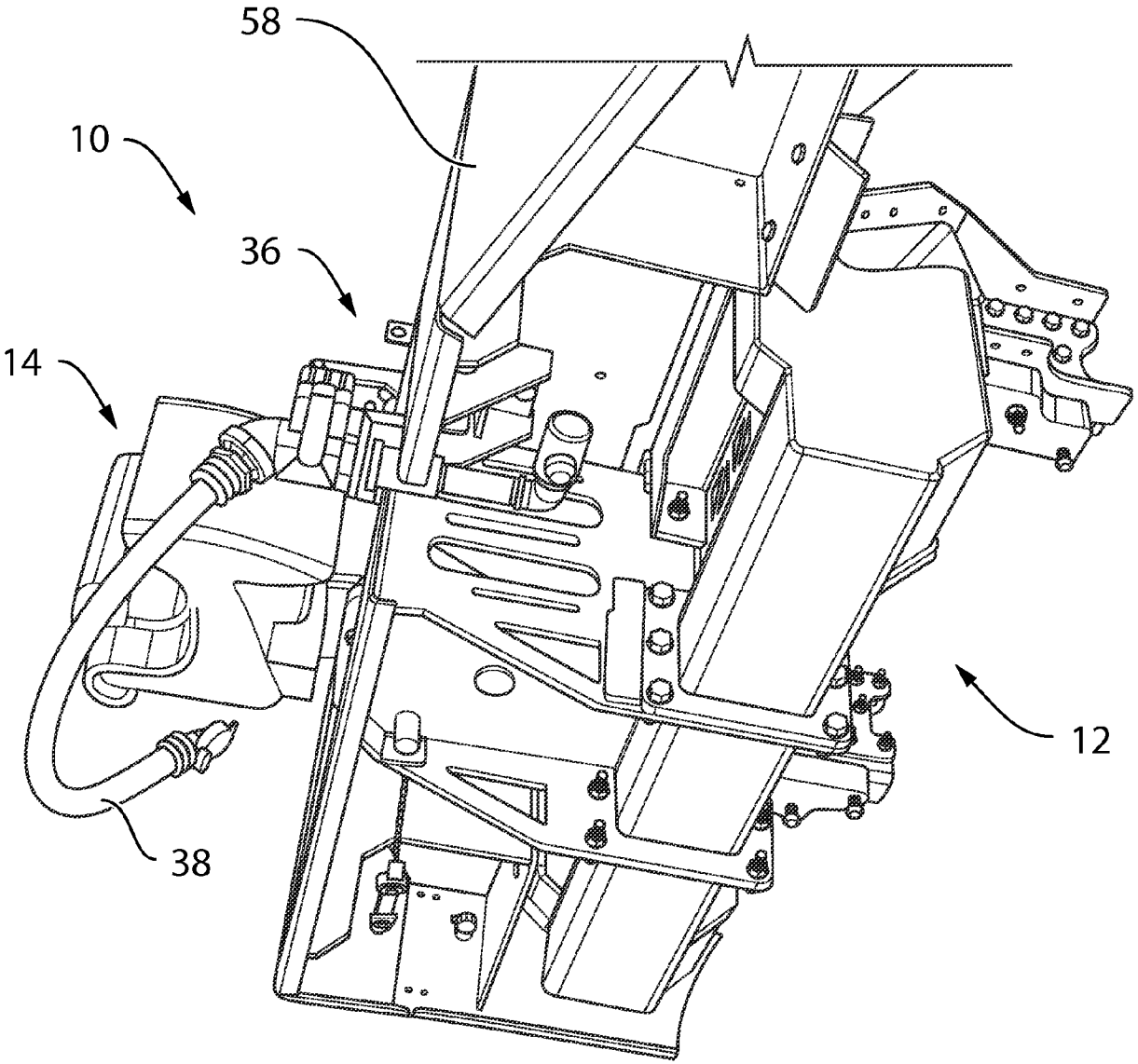
FIG. 3*a* is a bottom perspective view of a brake pipe according to the present disclosure in the extended position.
Figure 3B:
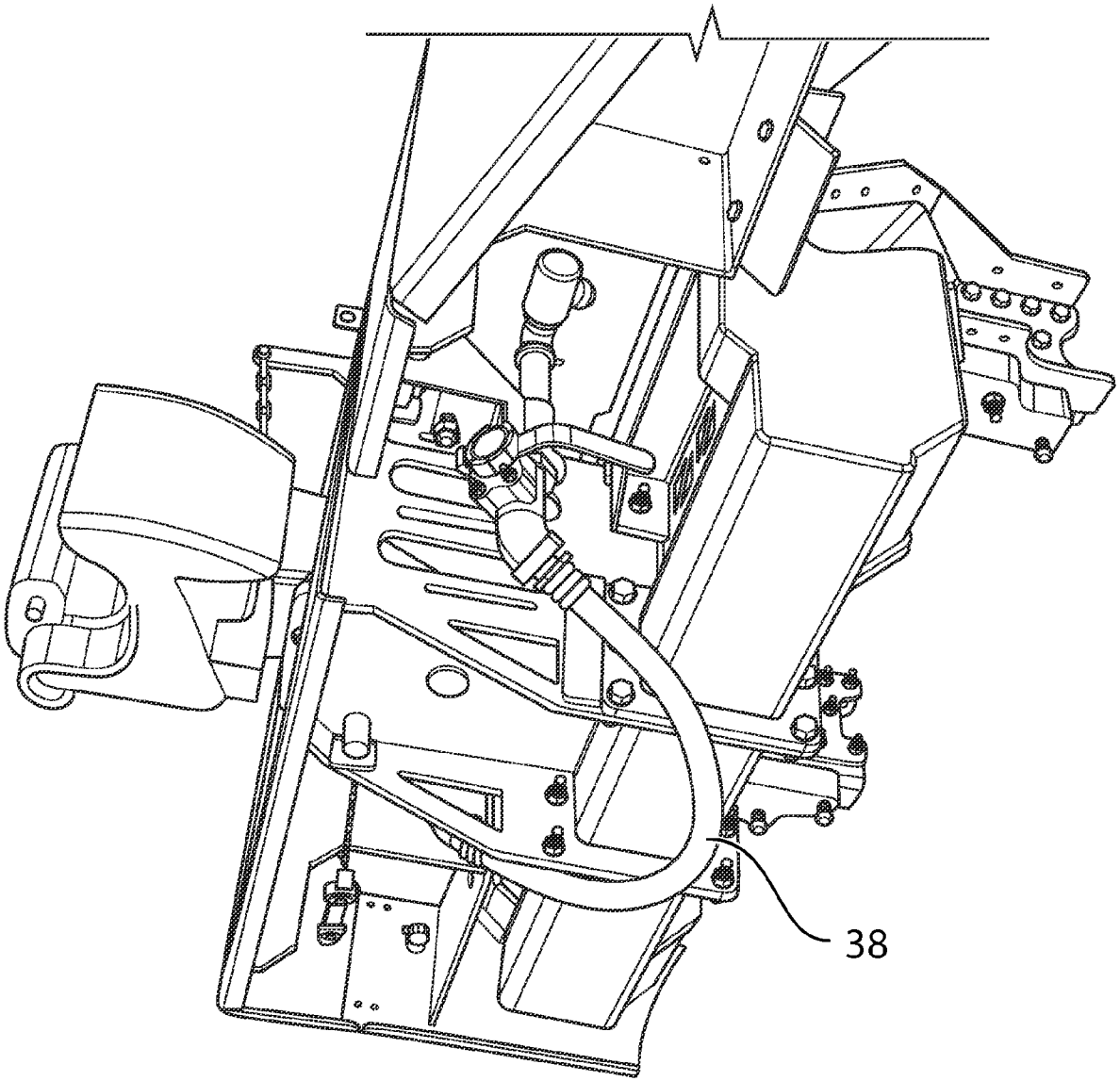
FIG. 3*b* is a bottom perspective view of the brake pipe of FIG. 3*a* in the stored position.
Figure 4A:
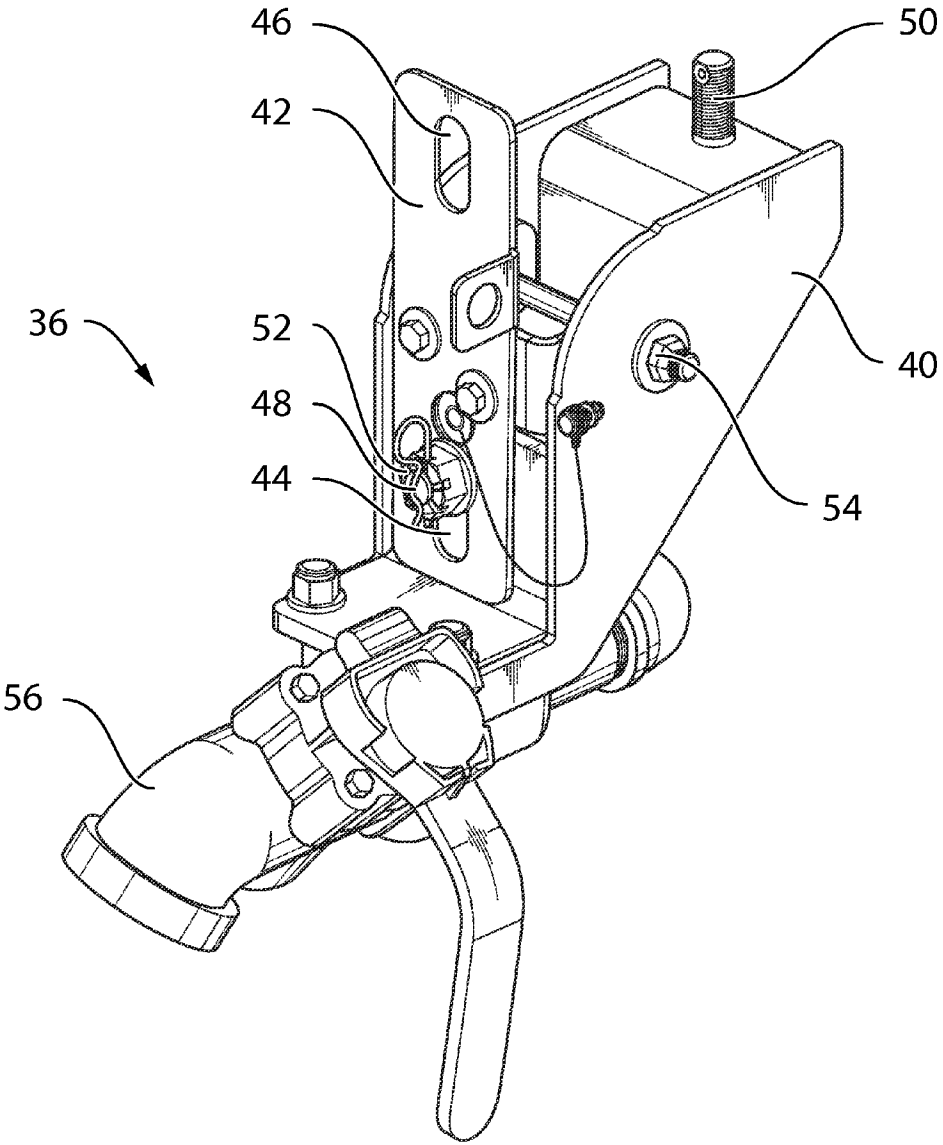
FIG. 4*a* is a detailed front perspective view of a brake pipe mounting bracket according to the present disclosure in the extended position.
Figure 4B:
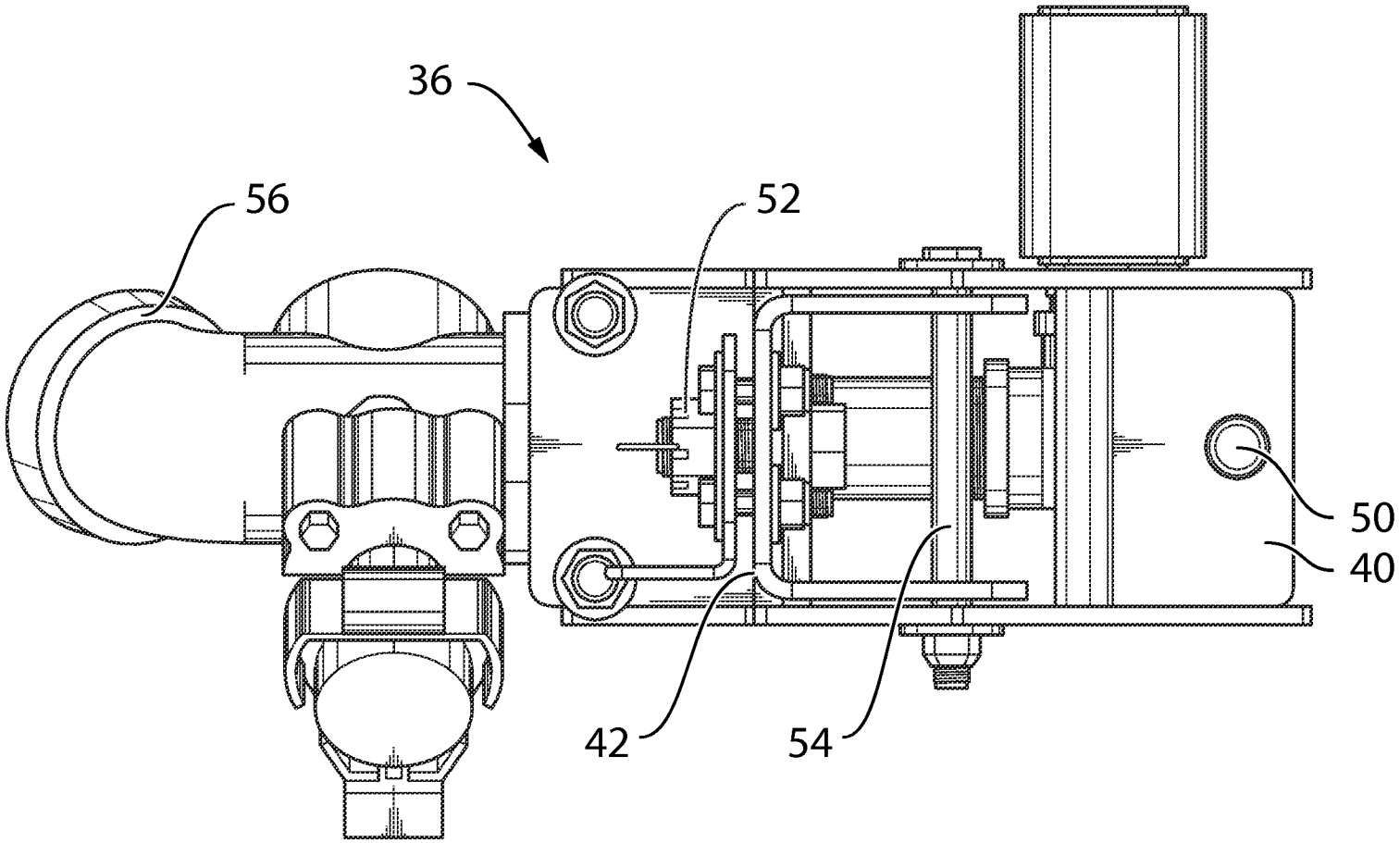
FIG. 4*b* is a top plan view of the brake pipe mounting bracket of FIG. 4*a* in the extended position.
Figure 4C:
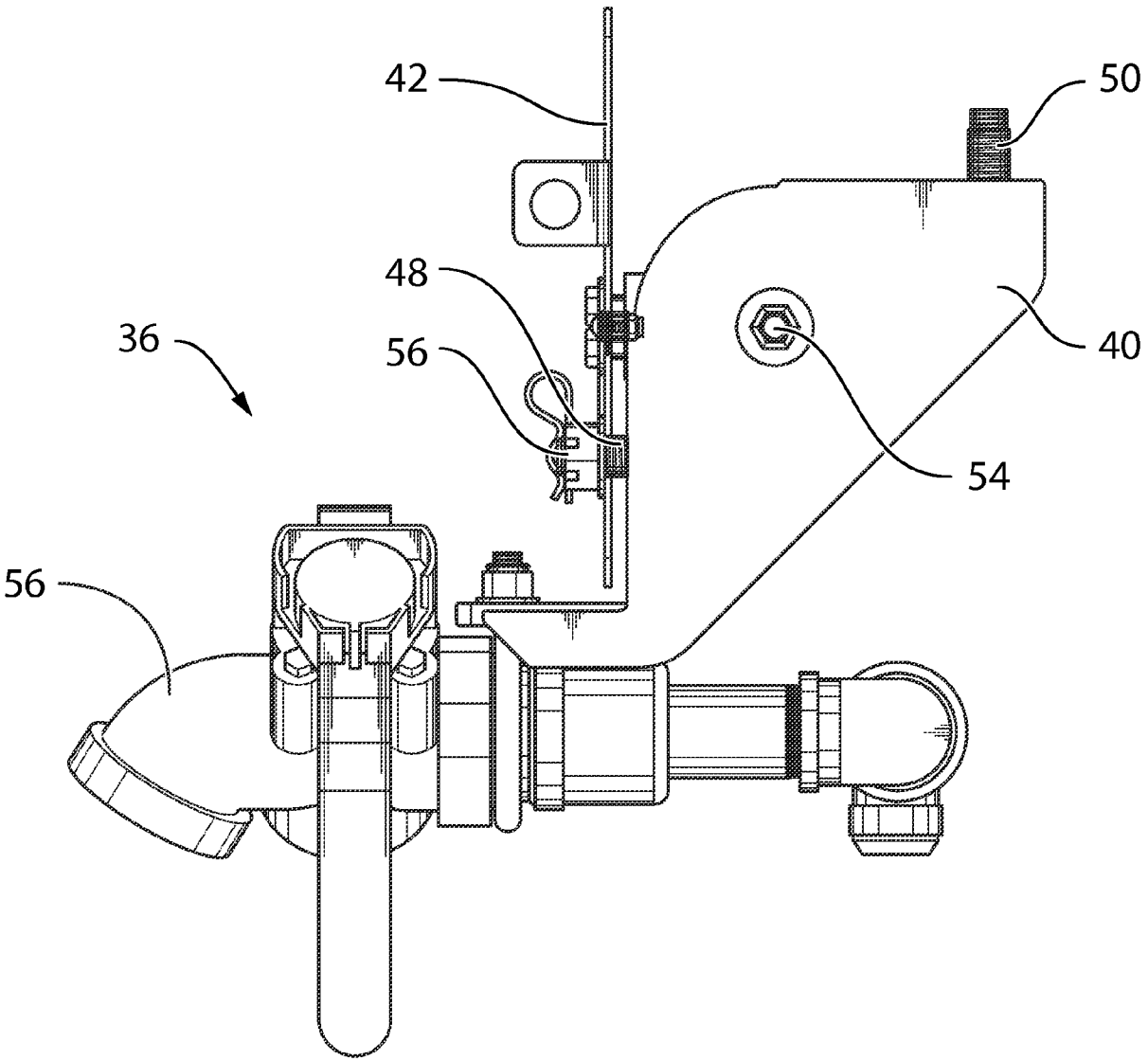
FIG. 4*c* is a side elevation view of the brake pipe mounting bracket of FIG. 4*a* in the extended position.
Figure 4D:
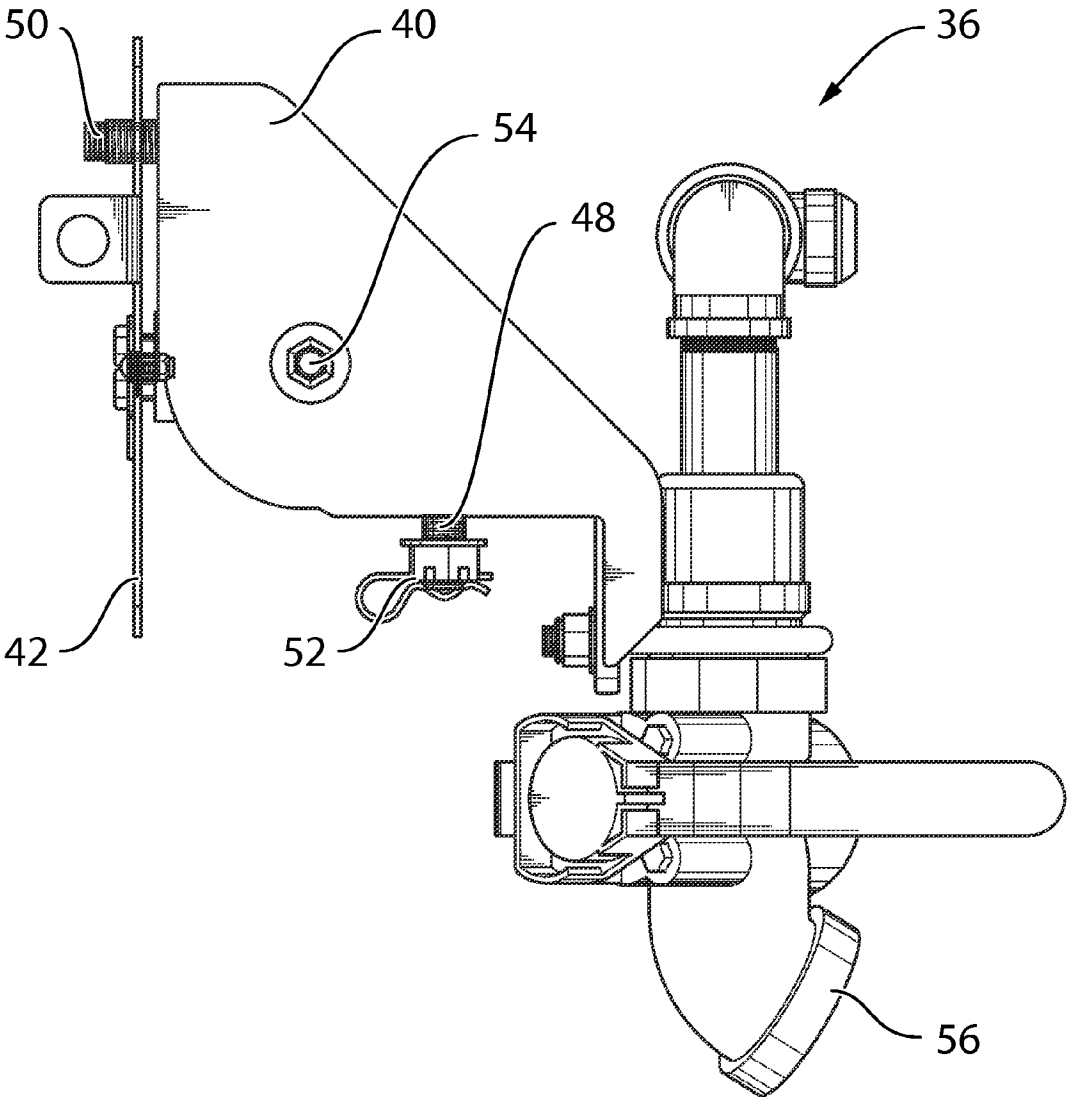
FIG. 4*d* is a side elevation view of the brake pipe mounting bracket of FIG. 4*a* in the stored position.

The exemplary embodiment has been described thus far by reference to the frame 12 without surrounding context, but it is the intention that advantageous functionality can be achieved by housing the frame 12 within the external surface or skin of the vehicle, including where such comprises a forward or rearward bumper as in the case of a road/rail vehicle. Turning now to FIGS. 2*e* and 2*f*, the assembly 10 is shown housed within a bumper 58 of a rail-supported vehicle. The bumper 58 is provided with two apertures, a first aperture 60 and a second aperture 62, for extension of assembly components. Specifically, the first aperture 60 is located and configured to allow the passage therethrough of the first end 16 of the coupler 14 when the coupler 14 is in the extended position, and the second aperture 62 is located and configured to allow the passage therethrough of part of the rotatable brake pipe mounting bracket 36, discussed below. Although the two apertures 60, 62 are shown as discrete, it would be obvious to combine them in a single aperture. When retracted back through the apertures 60, 62, the assembly components do not add to the external length of the vehicle.

Turning now to FIGS. 3*a* through 4*d*, another aspect is illustrated in detail, namely the rotatable brake pipe mounting bracket 36. The bracket 36 is configured to receive an end of the brake pipe 38 and enable connection to the brake pipe of an adjacent vehicle. The devices and methods of the present disclosure allow for retraction of the coupler 14, but also the brake pipe 38 itself which could otherwise extend forwardly or rearwardly of the vehicle exterior surface.

The bracket 36 comprises a securing plate 42 attached to the vehicle and a rotatable mount 40 mounted thereon. The rotatable mount 40 is connected to the securing plate 42 by means of a pivot bar 54, such that the mount 40 can rotate between upward and downward positions, as will be described further below. The rotatable mount 40 is configured to retain a connector 56 for the brake pipe 38.

The securing plate 42 has two spaced apart receiving holes 44, 46 therein for alternative receipt respectively of bolts 48, 50. As can best be seen in FIGS. 4*c* (extended position) and 4*d* (stored position), the mount 40 is rotatable between an extended position wherein the brake pipe 38 projects outwardly and the bolt 48 is received in the corresponding hole 44 in the plate 42, and a stored position wherein the brake pipe 38 is retracted within the vehicle and the bolt 50 is received in the corresponding hole 46 in the plate 42. Retention means such as nut or pin 52 can be employed to ensure the mount 40 is held in the desired position.

As will be obvious to those skilled in the art, the present invention as illustrated by way of the exemplary embodiment provides numerous advantages over the prior art. For example, in the case of road/rail vehicles, the ability to retract both the coupler and brake pipe maximizes the useful vehicle length as protruding unused components would otherwise impact vehicle length under highway use regulations for such vehicles.

The foregoing is considered as illustrative only of the principles of the invention. The scope of the claims should not be limited by the exemplary embodiment set forth in the foregoing, but should be given the broadest interpretation consistent with the specification as a whole.

What is claimed is:

1. A coupler assembly for use with a rail-supportable vehicle comprising:

a frame for mounting substantially within an exterior surface of the vehicle adjacent a first aperture in the exterior surface;

a coupler received within the frame, the coupler having opposed first and second ends, the first end configured for releasable engagement with an adjacent vehicle coupler and the second end pivotally mounted on the frame;

wherein the coupler is rotatable between a stored position substantially within the exterior surface and an extended position partially without the exterior surface through the first aperture for releasable engagement with the adjacent vehicle coupler; and a rotatable brake pipe mounting bracket for a brake pipe of the vehicle adjacent a second aperture in the exterior surface, the rotatable brake pipe mounting bracket configured to allow rotation of the brake pipe from a first position within the exterior surface to a second position partially without the exterior surface through the second aperture for engagement with an adjacent vehicle brake pipe;

wherein the rotatable brake pipe mounting bracket comprises first and second securing means, the first securing means configured to releasably secure the brake pipe in the first position and the second securing means configured to releasably secure the brake pipe in the second position.

2. The coupler assembly of claim 1 wherein the rotatable brake pipe mounting bracket is configured for mounting on the inside of the exterior surface adjacent the second aperture.

* * * * *